US005169458A

United States Patent [19]

Shulman et al.

[11] Patent Number: 5,169,458

[45] Date of Patent: Dec. 8, 1992

[54] METHOD OF IMPROVING THE CORROSION RESISTANCE OF ANODIZED ALUMINUM AT LOW TEMPERATURES

[76] Inventors: Garson F. Shulman, 23214 Anza Ave., Torrance, Calif. 90505; Albert J. Bauman, 524 Oakdale Dr., Sierra Madre, Calif. 91024

[21] Appl. No.: 473,865

[22] Filed: Feb. 2, 1990

[51] Int. Cl.[5] ..... C23C 22/56

[52] U.S. Cl. ..... 148/248; 148/251; 148/252; 148/272; 148/274; 148/275; 148/276; 428/472.2; 427/419.2; 205/201; 205/204

[58] Field of Search ..... 148/248, 251, 252, 272, 148/274, 275, 276, 277, 284, 285; 428/472.2; 204/38.3; 427/419.2; 106/14.05, 14.11, 14.12, 14.13, 14.14, 14.18

[56] References Cited

U.S. PATENT DOCUMENTS

| | | | |
|---|---|---|---|
| 3,418,219 | 12/1968 | Fahlbusch | 204/38.3 |
| 3,510,411 | 5/1970 | Kramer et al. | 204/38.3 |
| 4,083,756 | 4/1978 | Tajkowski | 427/419.2 |
| 4,130,466 | 12/1978 | Kramer | 204/38.3 |

*Primary Examiner*—Jay H. Woo
*Assistant Examiner*—Jeremiah F. Durkin, II
*Attorney, Agent, or Firm*—Louis J. Bachand

[57] ABSTRACT

Corrosion resistance of anodized aluminum surfaces is improved by conditioning the surface with a low molecular weight (2–7 carbon atoms) alcohol, and sealing the surface with long chain (10–24 carbon atom) carboxylic acid at low temperatures below about 35–50 degrees centigrade, the alcohol being a solvent for the acid.

17 Claims, No Drawings

METHOD OF IMPROVING THE CORROSION RESISTANCE OF ANODIZED ALUMINUM AT LOW TEMPERATURES

FIELD OF THE INVENTION

This invention has to do with improvements in the corrosion resistance of anodized aluminum. More particularly, the invention is concerned with treated anodized aluminum surfaces which have been coated to improve their corrosion resistance and specifically with novel methods for so coating such surfaces at ambient temperatures. In another aspect, the invention has to do with conditioning anodized aluminum surfaces to enhance subsequent sealing against corrosion deterioration.

BACKGROUND

In U.S. Pat. No. 3,510,411 to Kramer the use of straight chain aliphatic carboxylic acids on anodized aluminum surfaces is taught to be restricted to the use of high temperature conditions which effect a melt of the acid which is thus applied to the surface. This technique while effective to improve the corrosion resistance of anodized aluminum surfaces and to increase resistance to fatigue is inefficient, costly and cumbersome because of the tendency of the acid to oxidize at the elevated temperatures required by Kramer, and limited to less complex shapes of parts.

SUMMARY OF THE INVENTION

It is accordingly an object of the present invention to provide methods of improving the corrosion and fatigue resistance of anodized aluminum which is unlimited by oxidation considerations, is usable with complex shapes of parts and more economical than past methods.

This and other objects of the invention to become apparent hereinafter are realized in the method of increasing the resistance to corrosion of an anodized aluminum surface, including conditioning said surface with an alcohol, and immediately applying an effective amount of a long chain carboxylic acid to the conditioned surface at ambient temperatures.

In this and like embodiments of the invention, the method further includes: dissolving the acid in the alcohol for simultaneous application of the alcohol and acid to the surface; selecting as the carboxylic acid an acid containing from 10 to 24 carbon atoms; selecting as the alcohol an alcohol having from 2 to 7 carbon atoms; applying the acid at ambient temperatures below about 35 degrees Centigrade; and selecting isopropanol as the alcohol, stearic acid, isostearic acid or lauric acid as the carboxylic acid, and predissolving the acid in the alcohol at concentrations between 1% and 12% by weight before application to the surface.

There is further provided in accordance with the invention an anodized aluminum surface having increased corrosion resistance, comprising anodized aluminum conditioned with an alcohol and coated with a long chain carboxylic acid in corrosion resistance-increasing effective amount, e.g. from 0.1 mil to 5 mils or more.

In another aspect the invention provides a method of increasing the resistance to corrosion of an anodized aluminum surface, including forming a solution of a long chain carboxylic acid in an alcohol, and applying the solution to the surface at ambient temperatures in a manner to deposit the acid onto the surface in an amount effective to increase surface corrosion resistance.

In this and like embodiments, the invention contemplates: selecting an alcohol having from 2 to 7 carbon atoms as the alcohol; selecting isopropanol as the alcohol; selecting a long chain carboxylic acid having from 10 to 24 carbon atoms as the acid; selecting the acid from stearic acid, isostearic acid and lauric acid; applying the solution at a temperature of about 25 degrees Centigrade; applying the solution at a concentration of acid in alcohol of between 1% by weight and saturation; applying the solution to the surface promptly after anodizing the surface; selecting the alcohol from alcohols having from 2 to 5 carbon atoms; selecting isopropanol as the alcohol; using the isopropanol at concentrations of 3 to 15% by weight and preferably about 5%; and selecting a sulfuric acid/oxalic acid anodized aluminum surface as the surface to be treated.

PREFERRED MODES

It will be evident from the foregoing that a novel means of applying the long chain carboxylic acids is provided, involving a pretreatment of the anodized aluminum surface, with an alcohol, to form, it is believed, an alkoxide, with the result that the application of the acid is effective at lowered temperatures, below about 35 degrees Centigrade, to seal the pores in the the anodized surface and in that manner reduce the incursion of corrosive agents and increase the period during which the surface is corrosion resistant. While not wishing to be bound to any particular theory, it is believed that the prior art teaching of the necessary use of hot molten acid to get sufficient penetration of the anodize is the result of the art failing to appreciate the effect of pretreating or simultaneously treating the the anodized surface with a low molecular weight alcohol in aid of sealing the anodize surface with the high molecular weight acid.

It has been found that the lower molecular weight alcohols used herein while not themselves useful as corrosion enhancing agents are especially effective in aid of sealing with the carboxylic acids disclosed herein, including on hard and other anodic coatings which are not amenable to prior art processes. Thus, the patentees in U.S. Pat. No. 3,510,411 state that "hard anodic coatings formed by anodizing in an oxalate bath or by low temperature, i.e., less than about 50 degrees F., anodizing are unsatisfactory for purposes of the present invention" and specify anodized coating thicknesses of 0.3 to 0.7 mil of medium hardness. Further, they state "Impregnating is advantageously accomplished by the use of an essentially undiluted, terminally substituted aliphatic carboxylic acid having a straight or branched chain and at least about 16 carbon atoms per molecule and the impregnation is carried out at a temperature of at least 200° F."

As will be obvious from the invention examples hereinafter, excellent corrosion resistance can be obtained using hard (low temperature) anodized coatings formed in low temperature sulfuric acid-oxalic acid baths, even with coatings in the 0.7 to 0.3 mil thickness range. Dilute solutions in alcohol solvents (e.g. ethanol, 2-propanol) of octodecanoic acid provide nearly as much resistance to corrosion as the molten acid. Excellent corrosion resistance was obtained using the 12 carbon lauric (dodecanoic) acid. Impregnation was effected at ambient temperature (25° C.) using alcohol solutions.

Fairly good corrosion life was obtained from thick, medium hard coatings (3 to 5 mil), room temperature anodized, then impregnated with alcohol solutions of octadecanoic (stearic) acid as much as 30 days after anodizing. In tests 1008 hours to failure was obtained in salt spray for 2024 alloy as compared with 2850 hours with no failure for specimens treated immediately (within 4 hours).

The preparation of medium-hard anodized coatings suitable for impregnation is described in U.S. Pat. No. 3,510,411. Corresponding hard-anodized coatings can be prepared by anodizing at 28 to 40 degrees F. in 15 to 25% sulfuric acid or in similar baths with 1 to 2% oxalic acid added.

The impregnation is best carried out immediately after anodizing, rinsing, and drying, but delays of up to 8 hours are acceptable. Appreciable protection is afforded with thick (4 mil) anodized coatings treated as much as 30 days after anodizing.

The concentration of long chain carboxylic acid in solvent can vary widely, from 1% to a saturated solution. Too low a concentration results in insufficient coverage of the surface; too high a concentration leaves excessive residue when solvent is evaporated. Best results are obtained with concentrations of 1 to 12% and preferably 2 to 5%. Lower alcohol solvents work best, perhaps because the aluminum alkoxide formed initially on the surface is readily replaced by the stronger carboxylic acid to form aluminum carboxylate. Satisfactory results can not be obtained using non-hydroxylic solvents such as ketones, esters, and fluorocarbons. Without being bound by theory, we postulate that the oxalic acid is prevented from attaching to the coating by the high concentration of the strong acid (sulfuric) present. A surface aluminum sulfate, being soluble, is then removed during rinsing, leaving a reactive aluminum oxide surface.

U.S. Pat. No. 3,510,411 teaches that temperatures of at least 250° F. are required to reduce viscosity, so that acid can permeate the anodized coating. Contrary to this teaching, it has been found that the use of ethyl and isopropyl alcohol used as solvents treat the surface and enable use of ambient temperature, e.g. 25° C. and just to 35°-50° C. to obtain coatings which give excellent results in extending corrosion resistance.

EXAMPLE I

Panels of several aluminum alloys measuring 3 in.×10 in.×⅛ in. were anodized in a 35° F. bath of 20% sulfuric acid, 2% oxalic acid, balance water to a 0.7 mil thickness of anodized coating, rinsed, and dried. Panels were immersed in 5% solutions of various carboxylic acids in various invention [low molecular weight alcohol] and control [nonalcohol] solvents (1% concentration in the fluorocarbon) for 3 to 5 minutes at 27 degrees Centigrade, allowed to air dry, then scraped free of excess fatty acid with a plastic scraper and wiped with a paper towel soaked in the solvent. Results are given in Table 1. Salt spray testing was conducted as in ASTM Method B117, using 5% salt solution. Failure was defined as 5 or more pits per panel.

TABLE I

CORROSION TESTS ON ALUMINUM ALLOYS
UNITS: Hrs. to Failure or End of Test

| ALLOY | TREATMENT | SOLVENT | TIME | RESULT |
|---|---|---|---|---|
| 2024 | STEARIC ACID | IPA | 2856 | NO FAILURE |
| | STEARIC ACID | FC | <500 | FAILED |
| | STEARIC ACID | AA | <500 | FAILED |
| | STEARIC ACID | MIBK | <500 | FAILED |
| | LAURIC ACID | IPA | 2856 | NO FAILURE |
| | NONE | | 336 | FAILED |
| | UNANODIZED | | 24 | BAD CORROSION |
| 7075 | STEARIC ACID | IPA | 2550 | NO FAILURE |
| | NONE | | 336 | FAILED |
| 6061 | STEARIC ACID | IPA | 1350 | NO CORROSION |
| | NONE | | 2350 | NO CORROSION |

IPA = 2-PROPANOL; FC = FREON; AA = AMYL ACETATE; MIBK = METHYLISOBUTYL KETONE

EXAMPLE II

Samples were anodized as in Example I, but to a thickness of 3 mil. Impregnation, within 6 hours, was by immersion in 5% stearic acid/2-propanol solution. No corrosion was noted at 1350 hours with any of the 6061 alloy samples, including an anodized, unsealed control. There was no failure at 2350 hours with treated 7075 or treated 2024, but an anodized, unsealed control of these metals failed in less than 336 hours.

EXAMPLE III

Panels were anodized to a thickness of 4 mils in a 75° F. bath of 20% sulfuric acid, rinsed, and dried. After a period of 30 days, they were impregnated with 7.5% solutions of various acids dissolved in isopropyl alcohol. After 336 hours, lauric acid treated specimens of 2024 had failed, but stearic acid and 50% palmitic-50% stearic acid treated specimens were not corroded. Testing of these was continued to failure (5 or more pits) at 1008 and 648 hours, respectively. Neither a 6061 control or treated specimen failed in 2080 hours of testing.

EXAMPLE IV

Samples were anodized as in Example I. Impregnation was by immersion in 5% solution of stearic acid in propylene glycol solvent rather than an alcohol. The solvent was removed by rinsing 3 times with distilled water. Salt spray testing resulted in failure before 500 hours.

We claim:

1. Method of increasing the resistance to corrosion of an anodized aluminum surface, including conditioning said surface with an alcohol, and immediately applying an effective amount of a long chain carboxylic acid having 10 to 24 carbon atoms to the conditioned surface at ambient temperatures between 25 and 50 degrees Centigrade.

2. The method according to claim 1, including also dissolving the acid in the alcohol at a concentration of at least about 1% by weight for simultaneous application of said alcohol and said acid to said surface.

3. The method according to claim 1, including also selecting as said alcohol an alcohol having from 2 to 7 carbon atoms.

4. The method according to claim 1, including also applying said acid at ambient temperatures below about 35 degrees Centigrade.

5. The method according to claim 1, including also selecting isopropanol as said alcohol, stearic acid, isostearic acid or lauric acid as said carboxylic acid, and predissolving said acid in the alcohol at concentrations between 1% and 12% by weight before application to the surface.

6. The method of increasing the resistance to corrosion of an anodized aluminum surface, including forming a solution of at lest about 1% by weight of a long chain carboxylic acid having 10 to 24 carbon atoms in an alcohol, and applying the solution to the surface at ambient temperatures between 25 and 50 degrees Centigrade in a manner to deposit the acid onto the surface and in an amount effective to increase surface corrosion resistance.

7. The method according to claim 6, including also selecting an alcohol having from 2 to 7 carbon atoms as said alcohol.

8. The method according to claim 7, including also selecting isopropanol as said alcohol.

9. The method according to claim 6, including also selecting a long chain carboxylic acid having from 10 to 24 carbon atoms as said acid.

10. The method according to claim 9, including also selecting said acid from one or more of stearic acid, isostearic acid, palmitic and lauric acid.

11. The method according to claim 6, including also applying the solution at a temperature of about 25 degrees Centigrade.

12. The method according to claim 6, including also applying the solution at a concentration of acid in alcohol of between 1% by weight and saturation.

13. The method according to claim 6, including also applying said solution to said surface promptly after anodizing said surface.

14. The method according to claim 6, including also selecting said alcohol from alcohols having from 2 to 5 carbon atoms.

15. The method according to claim 14, including also selecting isopropanol as said alcohol.

16. The method according to claim 15, including also using said isopropanol at carboxylic acid concentrations of 1 to 12% by weight.

17. The method according to claim 6, including also selecting a sulfuric acid/oxalic acid anodized aluminum surface as the surface to be treated.

* * * * *